US006168324B1

(12) United States Patent
Lever et al.

(10) Patent No.: US 6,168,324 B1
(45) Date of Patent: Jan. 2, 2001

(54) THERMAL TRANSFER PRINTER

(75) Inventors: Philip E Lever, Ipswich; Kent C Goddard, Overseal; Robert T Portus, Burton-on-Trent, all of (GB)

(73) Assignee: Imperial Chemical Industries PLC, London (GB)

( * ) Notice: Under 35 U.S.C. 154(b), the term of this patent shall be extended for 0 days.

(21) Appl. No.: 09/355,617

(22) PCT Filed: Jan. 30, 1998

(86) PCT No.: PCT/GB98/00286

§ 371 Date: Oct. 1, 1999

§ 102(e) Date: Oct. 1, 1999

(87) PCT Pub. No.: WO98/33652

PCT Pub. Date: Aug. 6, 1998

(30) Foreign Application Priority Data

Jan. 30, 1997 (GB) ..... 9701874

(51) Int. Cl.[7] ..... B41J 3/54
(52) U.S. Cl. ..... 400/82; 400/120.05
(58) Field of Search ..... 400/120.05, 613, 400/615.2, 621, 70, 71, 82, 188

(56) References Cited

U.S. PATENT DOCUMENTS

| | | | | |
|---|---|---|---|---|
| 4,208,666 | * | 6/1980 | Paranjpe | 346/75 |
| 4,747,707 | * | 5/1988 | Komori | 400/82 |
| 4,776,711 | * | 10/1988 | Harada | 400/82 X |
| 5,302,037 | | 4/1994 | Schoendienst et al. | 400/586 |
| 5,529,407 | * | 6/1996 | Ikeda et al. | 400/82 |

FOREIGN PATENT DOCUMENTS

| | | |
|---|---|---|
| 32 32 875 | 3/1984 | (DE) . |
| 26 890 | 4/1981 | (EP) . |
| 556 658 | 8/1993 | (EP) . |
| 659 569 | 6/1995 | (EP) . |
| 798 122 | 10/1997 | (EP) . |

OTHER PUBLICATIONS

Patent Abstracts of Japan, vol. 096, No. 008, Aug. 30, 1996 & JP 08 090806 A (Tec Corp), Apr. 9, 1996.

* cited by examiner

*Primary Examiner*—John S. Hilten
*Assistant Examiner*—Minh Chau
(74) *Attorney, Agent, or Firm*—Pillsbury Madison & Sutro LLP

(57) ABSTRACT

A thermal transfer printer comprises two parallel and adjacent print engines (1*a*, 1*b*), with each engine comprising a platen roller (4), a donor ribbon extending from a supply spool (10*a*, 10*b*) to a take-up spool (11*a*, 11*b*), and receiver supply rolls (5*a*, 5*b*) to hold a supply of receiver sheet. Drive means (11*a*, 11*b*; 26*a*, 26*b*) transport the donor ribbon and receiver sheet through the engine during printing independently from the drive means of the other engine. A printhead (3) has a row of heaters extending across both engines, with a first set (3*a*) of heaters positioned to operate with the first engine (1*a*) and a second set (3*b*) of heaters positioned to operate with the second engine (1*b*). Control means coordinate activation of the engines selectively with application of the image signal to the heater set which is operable with that selected engine. Both engines can be operated independently, enabling the printer to be set up for independent or dual printing.

9 Claims, 4 Drawing Sheets

THERMAL TRANSFER PRINTER

This application is the national phase of international application PCT/GB98/00286 filed Jan. 30, 1998 which designated the U.S.

FIELD OF THE INVENTION

The invention relates to thermal transfer printers, and especially to thermal transfer printers useful for service in photo booths.

BACKGROUND TO THE INVENTION

Thermal transfer printing is a process for generating printed images by transferring thermally transferable colorant from a thermal transfer donor sheet to a receiver. Donor sheets comprise a base film coated on one side with a transfer coat, the latter comprising either a non-transferable binder containing one or more thermally transferable dyes for dye diffusion or sublimation transfer, or an ink of colorant and fusible binder which also transfers with the colorant. Printing is effected by heating selected areas of the donor sheet while the transfer coat is pressed against the surface of the receiver, thereby to transfer the dyes or inks from those selected areas to corresponding areas of the receiver. This generates an image according to the areas selected. Being a dry process not requiring any reagent solutions, thermal transfer printing is particularly suited to occasional unsupervised operation in stand-alone photo booths.

At present the most common form of thermal transfer printer uses a thermal head with a row of tiny heaters to heat the selected areas while the donor sheet and receiver sheet are pressed together between the thermal head and a platen in the form of a roller. The areas to be heated are selected by electronic control of the heaters (e.g. according to a video-or computer-generated image signal), as the donor sheet and receiver are progressed between the thermal head and the platen, line by line. Clear, high resolution images can thus be built up.

By repeating the transfer process with each of the three primary colours, full colour images can be obtained. Donor sheets are normally in the form of long ribbons, having repeated sequences of print size panels of each primary colour and any other materials to be transferred, such sequence being repeated along the ribbon to enable it to be used for as many prints as there are repeats of the sequence. The majority of dye diffusion which are loaded as a stack of pre-cut receiver sheets to be fed to the printhead in turn, as required for printing. However, such printers are not well adapted for general use in photo booths and other applications where customer-initiated automated operation is required.

It is a primary aim of the present invention to provide a thermal transfer printer which is more adaptable for use in various aspects of photo booths.

THE INVENTION

According to the invention, there is provided a thermal transfer printer comprising:

(a) means to receive an electronic image signal;

(b) first and second parallel and adjacent print engines, each engine comprising a platen roller, means to hold a donor ribbon set comprising a donor ribbon extending from a supply spool to a take-up spool, means to hold a supply of receiver sheet, and drive means to rotate the platen roller and to transport the donor ribbon and receiver sheet through the engine during printing independently from the drive means of the other engine;

(c) a printhead having a first set of heaters being positioned to operate with the first engine and a second set of heaters being positioned to operate with the second engine; and (d) a control means to coordinate activation of the drive means of one of the engines selectively with application of the image signal to the heater set which is operable with that selected engine.

The two sets of heaters are preferably incorporated in a single row extending across both engines.

Because both engines can be operated independently, the printer can be set up for independent or dual printing. The latter is particularly advantageous where multiple copies of the same image are required without undue delay. Typically, two full-colour A6 prints may take 1½minutes to produce sequentially, and such delay can be tiresome for customers and unhelpful in heavily used printers. Where such multiple applications are required, a preferred printer is one wherein the control means can be set up to direct the image signal to both sets of heaters while activating the drive means of both engines simultaneously. The print time may then be halved to about 45 seconds.

However while operation in this mode may be advantageous for speeding up heavily used photo booths other benefits can accrue by setting up the control means to direct the image signal to one set of heaters only, and correspondingly activating only the drive means of the engine with which that set of heaters is operable. One or other engine may then be selected according to the nature of the media installed. For example the two engines may be loaded with receiver sheets having different formats or preformed security marks, e.g. for providing prints for different applications such as passports, driving licences or security passes having different requirements, or one engine may be loaded with black donor ribbon, while the other has a ribbon for providing full colour prints. These options may be selected by the control means in response to a manual input, such as a security code, for example. None of these facilities can be achieved in a conventional printer as described in the background section above.

In all such instances where the printer is set up to produce prints from both engines simultaneously or to select one or other engine according to requirements, the printer ceases to function in the manner expected when the media loaded into either engine becomes used up. Also the operator would need to waste partially used media or try to make the service call coincide with the media finish. It is therefore preferred to set up the printer in this manner only where the booths are located in the operator's place of business, or otherwise such that immediate attention can be given in the event of such stoppage. Such problems (which also would be suffered by the above-described conventional printers without the present benefits) may otherwise be alleviated to some extent by frequent operator inspection.

Unfortunately, stand-alone photo booths tend to be set up in locations remote from their operators, and are expected to work unsupervised between media replenishments. Furthermore each operator's various booths may be scattered with a wide geographical spread. Where the printers are to be installed in such remote photo booths it is preferred to use printers according to the invention wherein the control means is connected to detectors to sense the status of at least one of the donor sheet and receiver sheet supplies for both engines, and wherein the control means is responsive to a detected status in determining which set of heaters to select for receiving the image signal and correspondingly which drive means to activate. The status of a media supply and the manner of its being sensed can be various. Thus for example a detector may be used which senses movement of the donor sheet or receiver sheet, or more specifically senses lack of such movement when it is expected during printing, and thereby indicates a jam or other malfunction, such that the control means responsive to such information may switch the printing to the other engine to await the next visit by the operator.

A more generally preferred printer having such features is one wherein each engine has a detector to sense the depletion of at least one of the donor ribbon supply and the receiver sheet supply, and, responsive to sensing such media-depletion in one engine, the control means activates the drive means of the other engine and directs the image signal to the set of heaters operative with that other engine. This increases the overall reliability of the photo booth and allows more efficient use of media, because each time, the operator replenishes it he can replace the fully used media in one print engine and leave the partially used media in the other engine until that similarly becomes depleted; thus ensuring efficient media usage.

Where the printers are to be installed in remote photo booths, it is preferred to use printers according to the invention wherein both print engines are adapted to receive a receiver sheet supply comprising a continuous strip in roll form. When using receiver sheet in roll form, it is preferred that each engine is also provided with print separation means, to separate the printed portion from the remaining strip still to be printed. The separation means could be a simple serrated edge against which the receiver is torn after the printed portion emerges from the print outfeed. A much neater edge can be obtained by fitting a guillotine adjacent to the print outfeed.

This roll fed receiver enables much larger supplies of receiver sheet to be used. Thus the number of blank sheets that a cut sheet fed printer can hold at one time is limited, by conventional design, to approximately 100 repeats. These limitations are centred around maintaining contact between the top of the receiver stack and the receiver infeed roller, as the stack size reduces. The present roll fed printers have the capability of holding sufficient media (donor sheet and receiver sheets), to produce much larger numbers of images. e.g. 1000, before media replenishment is required. This can be a significant advantage for remote photo booths. Such larger quantities of receiver sheet in roll form can also be incorporated more readily in low profile hardware to fit below the camera in existing booth designs.

A further advantage which the preferred roll fed printer has over conventional cut sheet fed printers is one of reliability. Transporting cut receiver sheet through a printer is often problematical and can lead to misregistration of the image relative to the receiver, or to receiver jams within the printer mechanism. The seriousness of this fault is exacerbated when occurring in photo booths which are remote.

Single roll fed receiver printers are not new per se, and largely overcome the problems of cut sheet fed printers mentioned above. However, commercial printers having a single roll fed receiver supply do not have the advantages of the twin engine printer of the invention, and again the operator would need to waste partially used media rolls (both donor ribbon and receiver) if he were unable to make the service call coincide with the finish of the media rolls.

In summary, the printer described herein is primarily aimed at the photo booth market. This market has a particular set of requirements that have not previously been fully met by any commercially available printer. Having two receiver roll fed engines in the same printer and a means of switching between the two in the event of printer failure or empty media supplies, increases the overall reliability of the photo booth and allows more efficient use of media by enabling the operator to replace the fully used media in one engine and leave the partially used media in the other, thus ensuring efficient media usage. With previous printers having only one engine, the operator needed to waste partially used intervals between media replenishments through greater reliability and the ability to load larger amounts of media can also provide significant cost savings to a photo booth operator.

A preferred printer loaded ready for use is one wherein both engines are loaded with a receiver sheet supply comprising a continuous strip of receiver sheet in roll form and a donor ribbon set comprising a dyesheet ribbon extending from a supply spool to a take-up spool and having a dyecoat containing thermally diffusible dyes, and wherein the control means is set up to direct incoming image signals only to one set of heaters until it receives a depleted media supply signal from the detector, and thereupon direct further image signals to the other set of heaters.

According to a further aspect of the invention, there is provided a method of thermal transfer printing which comprises feeding a plurality of image signals in turn to a loaded printer as described above, printing images represented by those signals onto one of the receiver strips until the control means switches printing of any further image signals to the other receiver strip in response to a depleted media supply signal, then reloading the depleted supply means with further media.

DESCRIPTION OF EMBODIMENT

The invention is further described with reference to a specific embodiment shown in the accompanying drawings, wherein.

Figure 1:
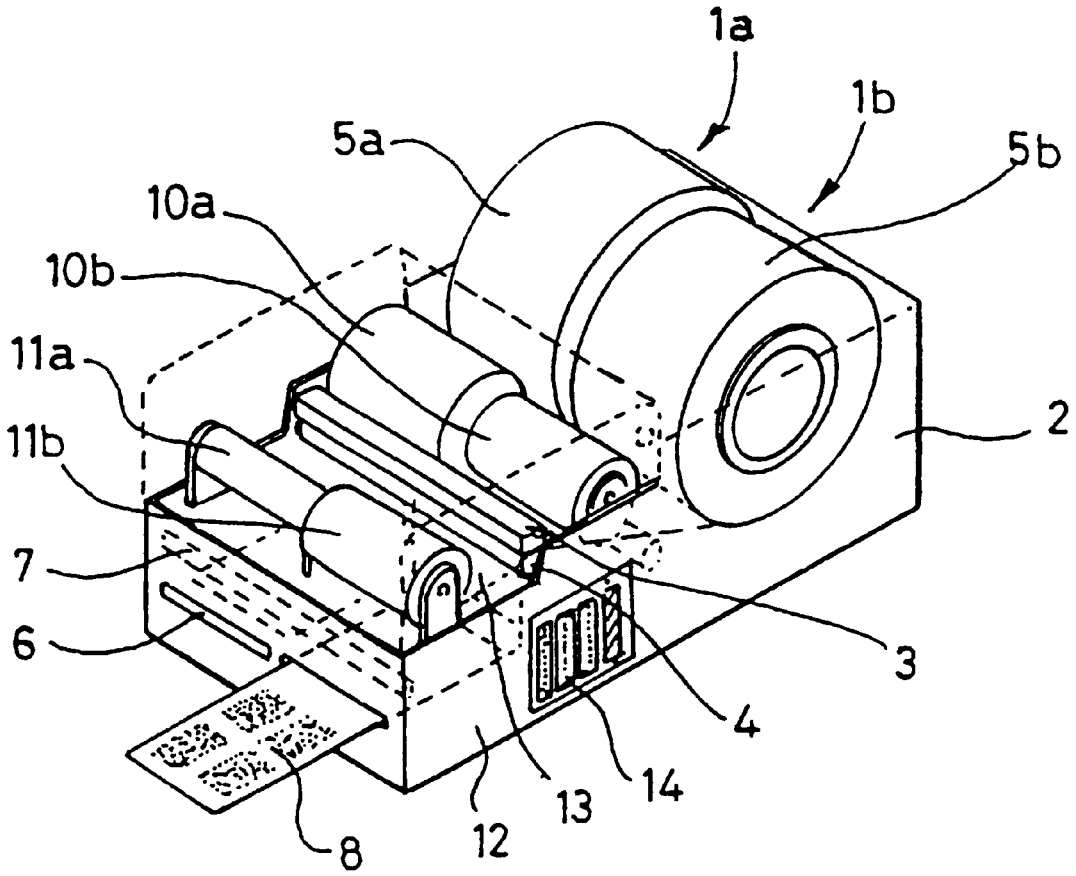
FIG. 1 is an isometric sketch showing the basic outline of a high volume dye diffusion printer according to the invention.

Referring to the drawings, the printer comprises two parallel A6 engines 1*a* and 1*b* mounted within a single chassis 2 and capable of independent or dual simultaneous usage. A single A4 printhead 3 and head actuation assembly extends the full width of the chassis, and straddles both print engines. The printhead 3 has two sets of heating elements, 3*a*, 3*b*, one for each engine. Below the printhead is a split platen roller 4, centrally supported to minimise deflection caused by the applied printhead pressure during printing. Each of the two parts of the split platen roller is separately driven, and provides an A6 width platen roller for the print engine in which it is located.

Figure 2:
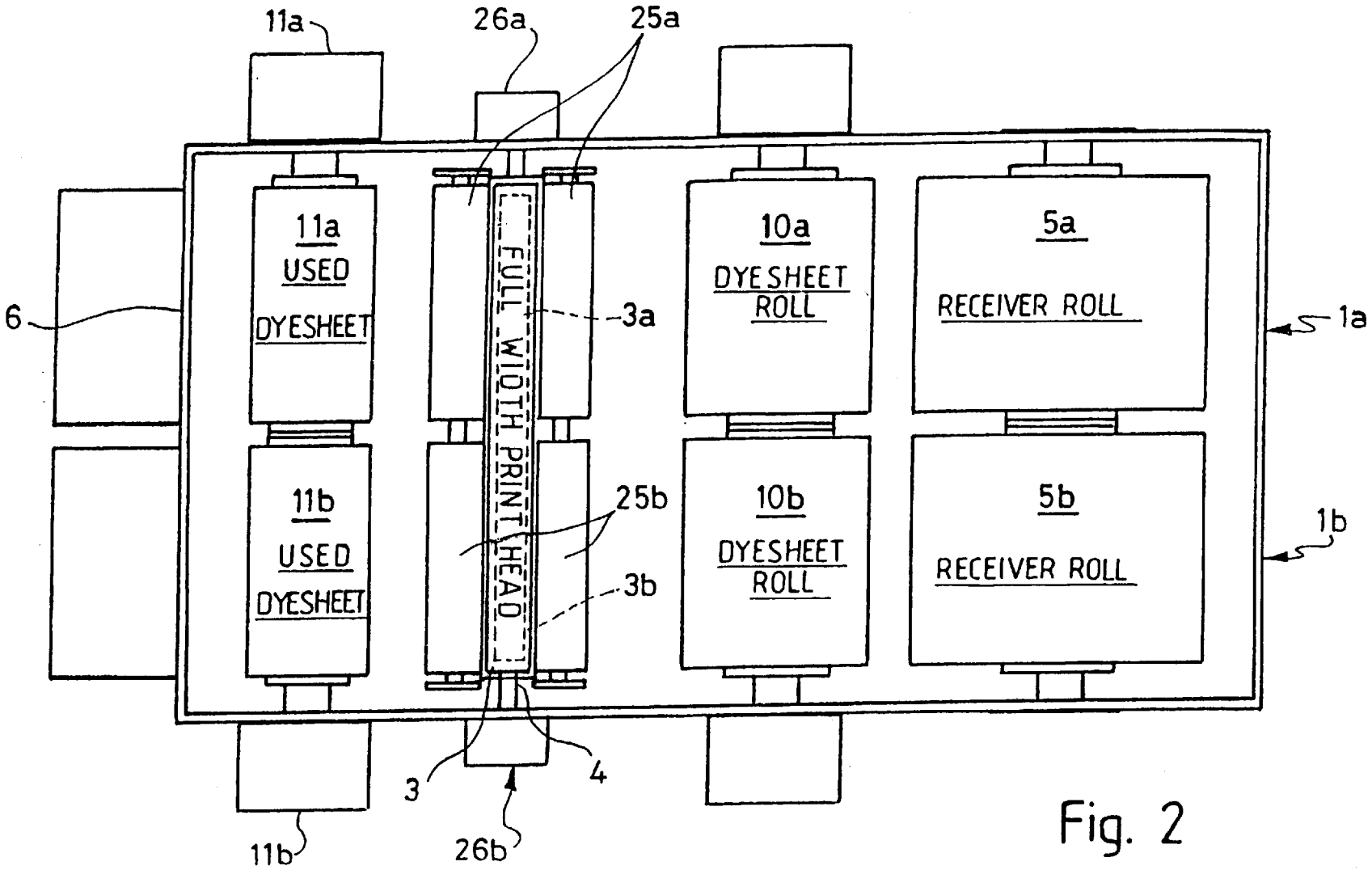
FIG. 2 is a somewhat diagrammatic plan view of the printer.

Each print engine has its own separate receiver sheet supply roll 5*a* and 5*b* positioned at the back of the print engine. Each receiver sheet, in the form of a continuous strip, is guided by guide rollers 24*a*, 24*b* to and over the platen roller 4 to a print cutfeed 6 at the front of the printer. The receiver strip has approximately 180 degrees of wrap around the platen roller 4 and is kept in contact with the platen by two separately actuated nip rollers 25*a*, 25*b* positioned either side and parallel to the platen. The receiver strip is friction fed through the printer by the platen 4 and nip rollers 25*a*, 25*b*. The split platen roller 4 has independent drives 26*a*, 26*b* (FIG. 2). A guillotine 7 is contained within the printer and is positioned just in front of the print outfeed. It extends the full width of the printer and is capable of cutting both sets of receiver sheet that pass underneath it.

FIG. 1 shows the receiver strip from supply roll 5*a* in a dormant state awaiting printing, while the end portion of the receiver strip from the other supply roll 5*b* is shown to have images 8 printed on it, and to be awaiting operation of the guillotine to separate it from the remainder of the strip. FIG. 2 shows both receiver strips in a print outfeed position.

Within the printer are separate first and second donor ribbon sets, one for each engine, comprising donor or dyesheet ribbons stretching from supply spools 10*a* and 10*b* to respective take-up spools 11*a* and 11*b*. The take-up spools are independently driven by a motor via a torque limiting device, as indicated at 11*a* and 11*b* in FIG. 2. The dyesheet supply spools are not driven, but each has a torque limiting device to set dyesheet simply in spool format.

Figure 3:
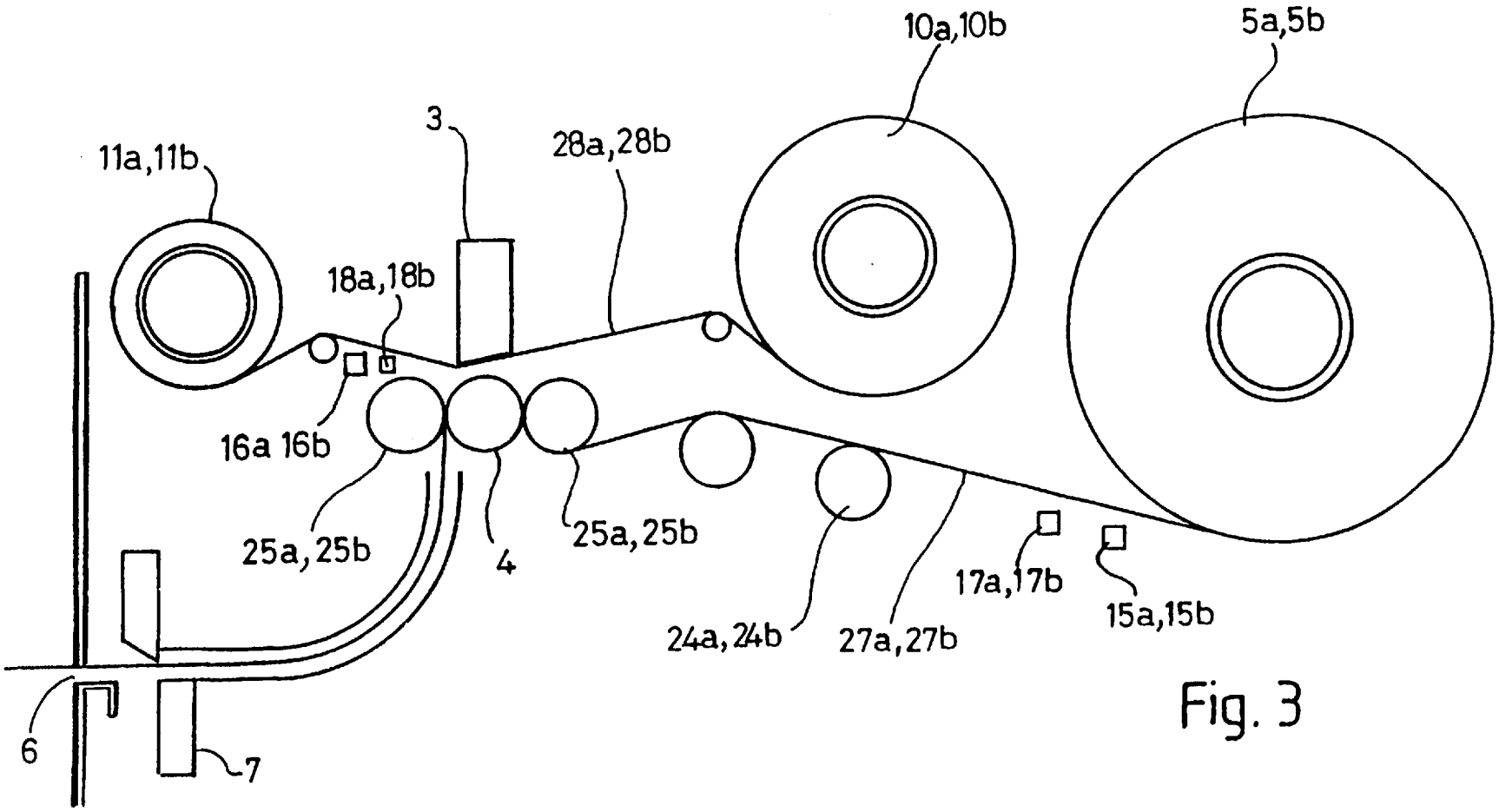
FIG. 3 is a somewhat diagrammatic cross-sectional view taken through the printer.

In FIG. 3, the receiver sheets are shown at 27*a*, 27*b* and the donor or dyesheet ribbons at 28*a*, 28*b*.

As shown in FIG. 3, associated with the receiver strip and the donor ribbon for each engine are respective detectors 15*a*, 15*b* and 16*a*, 16*b*, for sensing a status of the strip and the ribbon. respectively, e.g. detecting whether or not the strip or ribbon is moving or is stationary. The detectors 15*a*, 15*b* and 16*a*, 16*b* are connected to control means of the printers to give a status report, in consequence of which the control means may decide which set or sets of heating elements to feed with image signals and/or which drive means to operate.

Additionally, presence sensors 17*a*, 17*b* and 18*a*, 18*b* are provided to detect depletion of the receiver strip or the donor ribbon so that when, for example, the printer is being operated with one engine active only, the control means can switch the drives and image signals to the other engine when a depletion is sensed.

The chassis consists of a base 12 and hinged lid 13. The printhead assembly is contained within the hinged lid, to be positioned between the dyesheet supply spools and the take-up spools when the lid is closed. This allows easy access to the dyesheet for replenishment and to the printhead for cleaning and/or replacement.

The control means comprises a PC mother board and electronics contained within the chassis base, with PC peripheral boards 14 positioned along the side of the printer. This provides a low cost platform to which minimal extra hardware is required to control the printer. It can also be used to control other devices within a photo booth, e.g. user display graphics, user input, coin operation, booth lighting etc. However, external PC boards may be used instead, where appropriate.

So far as each individual engine is concerned, once the image signal has been directed to the appropriate set of heaters in the printhead, the printing operation is carried out in known manner, as described in the background section hereinabove. However, to make use of the greater versatility of the printer when set up for use in remote photo booths, a further aspect of the invention provides a method of thermal transfer printing which comprises feeding a plurality of image signals in turn to the printer, printing images represented by those signals onto one of the receiver strips until the control means switches printing of any further image signals to the other receiver strip in response to a depleted-supply signal, then reloading the depleted supply means with further media.

Figure 4:
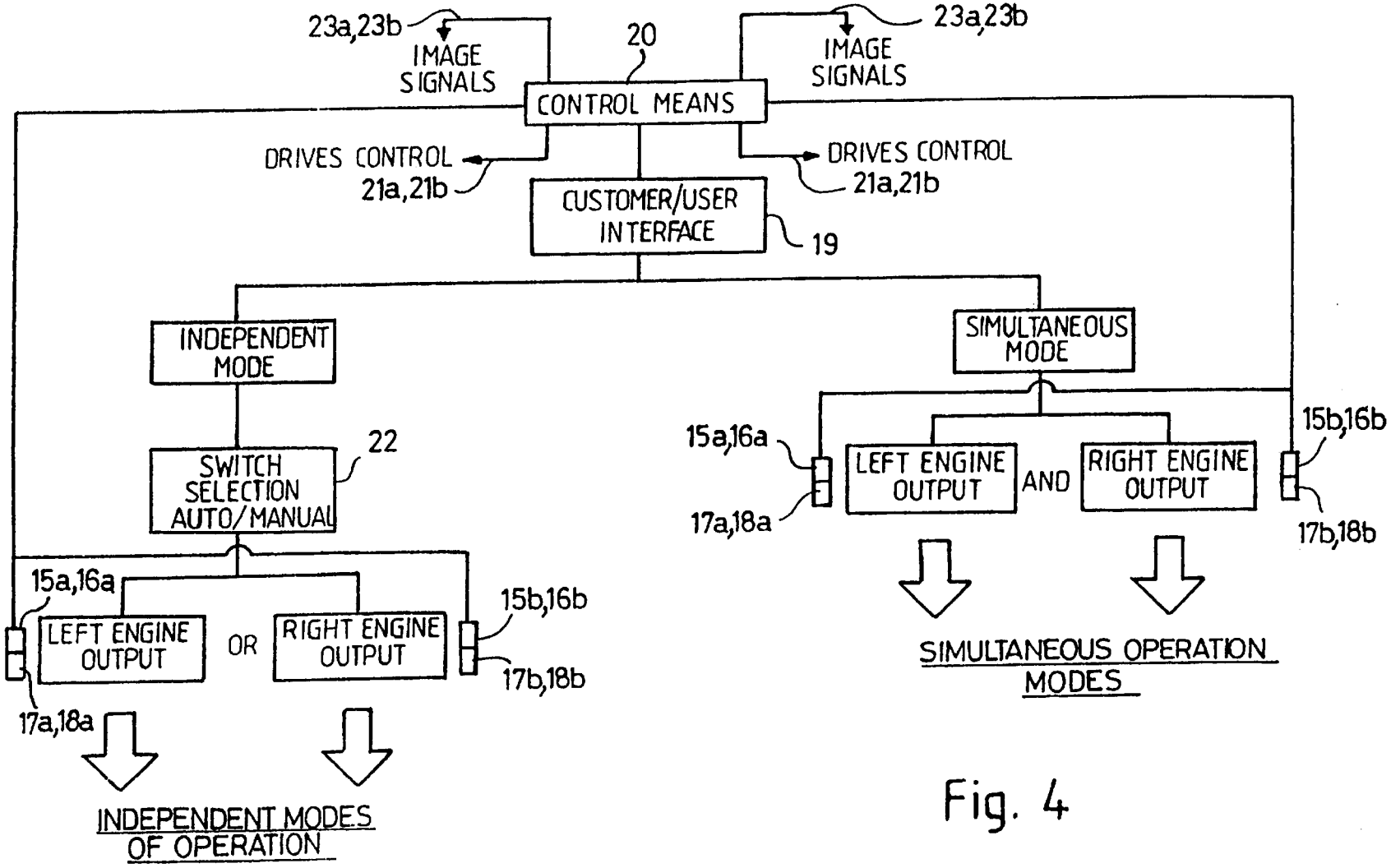
FIG. 4 is a logic diagram.

FIG. 4 is a logic diagram which explains the versatility of the printer. At the customer/user interface 19 associated with the control means 20, the control means can be set up to provide drive control signals 21*a*, 21*b*, so that the two engines are selected either for independent or simultaneous modes of operation.

If the independent mode is selected, automatic or manual control of printing can be selected at switch 22 and the outputs of the respective engines (say left and right engines) are dependent on the media to be printed. Thus, if the printer is set up so that both engines contain the same media, continuous operation takes place until either the media is depleted or an empty spool or a fault is detected. If the printer is set up with differing media, e.g. colour and black/white in the two engines, differing media outputs become available to the user.

If the simultaneous mode is selected the available outputs possible, dependent on the set up of the printer, are:

duplicate outputs of the same image (identical image signals 23*a*, 23*b*) in the same media;

b) dual outputs of differing images (differing image signals 23*a*, 23*b*) on the same media;

c) dual outputs of the same image on media of differing types or formats; and d) dual outputs of differing images on media of differing types or formats.

What is claimed is:

1. A thermal transfer printer comprising:

(a) means to receive an electronic image signal;

(b) first and second parallel and adjacent print engines, each engine comprising a platen roller, means to hold a donor ribbon set comprising a donor ribbon extending from a supply spool to a take-us spool, means to hold a supply of receiver sheet, and drive means to rotate the platen roller and to transport the donor ribbon and receiver sheet through the engine during printing independently from the drive means of the other engine;

(c) a printhead having a first set of heaters being positioned to operate with the first engine and a second set of heaters being positioned to operate with the second engine; and (d) a control means to coordinate activation of the drive means of one of the engines selectively with application of the image signal to the heater set which is operable with that selected engine, wherein the control means can be set up either to direct the image signal to both sets of heaters while activating the drive means of both engines simultaneously, or to direct the image signal to one set of heaters only, correspondingly activating only the drive means of the engine with which that set of heaters is operable.

2. A printer as claimed in claim 1, having a two-set row of heaters extending across both engines.

3. A printer as claimed in claim 1, wherein the control means is connected to detectors to sense the status of at least one of the donor sheet and receiver sheet supplies for both engines, and wherein the control means is responsive to a detected status in determining which set of heaters to select for receiving the image signal and correspondingly which drive means to activate.

4. A printer as claimed in claim 3, wherein each engine has a detector to sense the depletion of at least one of the donor ribbon supply and the receiver sheet supply and, responsive to sensing such media depletion in one engine, the control means activates the drive means of the other engine and directs the image signal to the set of heaters operative with that other engine.

5. A printer as claimed in claim 3, wherein both print engines are adapted to receive a receiver sheet supply comprising a continuous strip in roll form.

6. A printer as claimed in claim 5, wherein each engine is also provided with print separation means, to separate the printed portion from the remaining strip still to be printed.

7. A printer as claimed in claim 6, wherein both engines are loaded with a receiver sheet supply comprising a continuous strip of receiver sheet in roll form and a donor ribbon set comprising a dyesheet ribbon extending from a supply spool to a take-up spool and having a dyecoat containing thermally diffusible dyes, and wherein the control means is set up to direct incoming image signals only to one set of heaters until it receives a depleted supply signal from the detector and thereupon to direct further image signals to the other set of heaters.

8. A method of thermal transfer printing which comprises feeding a plurality of image signals in turn to a printer as claimed in claim 7, printing images represented by those signals onto one of the receiver strips until the control means switches printing of any further image signals to the other receiver strip in response to a depleted-supply signal, then reloading the depleted supply means with further media.

9. A method of thermal transfer printing using the printer of claim 1, comprising the steps of fitting either receiver sheets of the same type or of differing types to the respective receiver sheet holding means, and feeding either the same or different image signals to the respective heating sets.

* * * * *